US008186525B2

(12) United States Patent
Cui et al.

(10) Patent No.: US 8,186,525 B2
(45) Date of Patent: May 29, 2012

(54) COUPLER AND ANTI-CREEP MECHANISM FOR THE SAME

(75) Inventors: Yingjun Cui, Qiqihar (CN); Yan Jiang, Qiqihar (CN); Qingmin Meng, Qiqihar (CN); Xiaolong Wang, Qiqihar (CN); Junlong Wang, Qiqihar (CN); Shengguo Cong, Qiqihar (CN); Long Chen, Qiqihar (CN)

(73) Assignees: Qiqihar Railway Rolling Stock Co., Ltd. (CN); Mudanjiang Jinyuan Coupler and Draft Gear Manufacturing Co., Ltd. (CN)

( * ) Notice: Subject to any disclaimer, the term of this patent is extended or adjusted under 35 U.S.C. 154(b) by 158 days.

(21) Appl. No.: 12/810,873

(22) PCT Filed: Jul. 22, 2009

(86) PCT No.: PCT/CN2009/072680

§ 371 (c)(1),
(2), (4) Date: Jun. 28, 2010

(87) PCT Pub. No.: WO2010/083672

PCT Pub. Date: Jul. 29, 2010

(65) Prior Publication Data

US 2011/0073555 A1 Mar. 31, 2011

(30) Foreign Application Priority Data

Jan. 21, 2009 (CN) ..... 2009 1 0008714

(51) Int. Cl.
*B61G 3/00* (2006.01)

(52) U.S. Cl. ..... 213/148; 213/146; 213/144; 213/142

(58) Field of Classification Search ..... 213/141, 213/142, 143, 144, 145, 146, 147, 148
See application file for complete search history.

(56) References Cited

U.S. PATENT DOCUMENTS 2,498,958 A * 2/1950 Kinne ..... 213/148
2,498,959 A * 2/1950 Kinne ..... 213/148

(Continued)

*Primary Examiner* — S. Joseph Morano
*Assistant Examiner* — Jason C Smith
(74) *Attorney, Agent, or Firm* — Woodcock Washburn LLP

(57) ABSTRACT

An anti-creep mechanism for coupler includes a lower lockpin rod, a coupler shank and a rotation shaft. The rotation shaft is disposed in an elongate mounting hole of the lower lockpin rod and a circular mounting hole of the coupler shank so that the lower lockpin rod and the coupler shank are hinged together. A boss is axially disposed on an upper surface of the rotation shaft, and a groove is axially provided in a wall of the mounting hole of the coupler shank above the rotation shaft to receive the boss of the rotation shaft. The rotation shaft is axially movable relative to the lower lockpin rod and the coupler shank and has two operating positions. When the rotation shaft is moved to the first operating position, an inner end portion of the boss is positioned in the elongate mounting hole of the lower lockpin rod, and a top wall of this elongate mounting hole abuts against the boss. If this lower lockpin rod is rotated in a coupler unlocking direction, the anti-creep bulge of the lower lockpin rod abuts against the anti-creep surface of the coupler shank. When the rotation shaft is moved to the second operating position, the boss is positioned in the groove of the mounting hole of the coupler shank, and the top wall of this elongate mounting hole abuts against an outer circumferential surface of the rotation shaft. The anti-creep mechanism for coupler of the present invention has a reliable dual anti-unlocking performance for coupler. Besides, the present invention further discloses a coupler.

9 Claims, 5 Drawing Sheets

U.S. PATENT DOCUMENTS 2,646,176 A * 7/1953 Wolfe ..... 213/144
2,709,007 A * 5/1955 Metzger ..... 213/146
2,866,560 A * 12/1958 Metzger ..... 213/148
2,919,038 A * 12/1959 Metzger ..... 213/148
3,387,716 A * 6/1968 De Penti ..... 213/100 R
3,433,369 A * 3/1969 Metzger et al. ..... 213/148
3,549,021 A * 12/1970 Metzger ..... 213/110
3,549,022 A * 12/1970 Metzger ..... 213/110
3,850,311 A * 11/1974 Kaufhold ..... 213/146
4,466,546 A * 8/1984 Altherr et al. ..... 213/148
5,833,086 A * 11/1998 Kaufhold ..... 213/148
2011/0073555 A1* 3/2011 Cui et al. ..... 213/148

* cited by examiner

COUPLER AND ANTI-CREEP MECHANISM FOR THE SAME

CROSS-REFERENCE TO RELATED APPLICATIONS

This application is the U.S. National Stage of International Application No. PCT/CN2009/072860 filed Jul. 22, 2009, which claims priority under 35 USC 119 (A-D) of Chinese Application No. 200910008714.6, filed Jan. 21, 2009, the disclosures of which are incorporated herein by reference in their entirety.

FIELD OF THE INVENTION

The present invention relates to coupling technology between carriages of railcar, and specifically to a coupler and an anti-creep mechanism for the coupler.

BACKGROUND OF THE INVENTION

The coupler is a functional component located at both ends of a locomotive or car and has a standard connecting contour. The coupler is used to achieve the coupling between locomotives or cars and transmit a longitudinal force (e.g. traction force or compression force).

At present, the automatic coupler is widely used in railcar, and mainly consists of three parts, i.e., coupler head, coupler shank and coupler tail. Some parts such as coupler knuckle, coupler knuckle lock, knuckle thrower, coupler knuckle pin and lower lockpin mechanism are installed in a cavity of the head of the coupler shank. The lower lockpin and a lower lockpin rod are hinged by rivet to form a lower lockpin mechanism. Two cars may be coupled with each other spontaneously when they are colliding, and a coupler lifting bar may be manipulated from outside to achieve the separation between coupled cars, so as to improve the operating efficiency in train marshalling and ensure the safety of operator. Conventional automatic coupler will be operated in three operating states, i.e., locked state, unlock state and full open state. Whether the coupler may be maintained well in three operating states in use is one of the important indexes for evaluating the safety and reliability thereof. When the coupler is in the locked state, a coupler knuckle lock stops a coupler knuckle from being opened and coupled cars cannot be separated spontaneously. When rotating the coupler lifting bar, the coupler knuckle lock is slightly lifted to the unlock position, and then the coupler is switched into the unlock state. The coupler knuckle will be opened under external force and separate cars. When the coupler lifting bar is rotated to the upmost position, the coupler knuckle is pushed to a full open position by the coupler knuckle lock and knuckle thrower. At this time, the coupler is switched into the full open state, and adjacent cars are prepared for coupling.

In various operating conditions, the coupler knuckle lock might be moved away from the coupler knuckle locking surface under gravity due to vibration and impaction and thus the coupler is in the unlock state, or the lower lockpin mechanism might be rotated due to the vibration of car and drive the coupler knuckle lock to move upwardly to the unlock position, thereby accidentally unlocking the coupler. As well known, such abnormal unlocking of the coupler will result in accidents such as separation between cars and abnormal parking of car, which seriously affects the normal transportation in the railway. Therefore, in order to improve the transportation efficiency and safety in the railway, it is very important to prevent the coupler from being abnormally unlocked.

In order to prevent the coupler from being abnormally unlocked, conventional automatic coupler is provided with an anti-creep mechanism. The lower lockpin rod and the coupler shank are hinged through a rotation shaft 30. In normal operating state, an anti-creep bulge 10 of the lower lockpin rod is separated from an anti-creep surface 20 of the coupler shank (as shown in FIG. 1*a*). At this moment, if the lower lockpin rod is rotated in a coupler unlocking direction, and drives the lower lockpin and the coupler knuckle lock to move upwardly to the unlock position, the coupler will be unlocked. In the case of vibration of car, the lower lockpin rod is moved upwardly and is in the anti-creep position. At this moment, if the lower lockpin rod is rotated towards the coupler unlocking direction, the anti-creep bulge 10 of the lower lockpin rod contacts with the anti-creep surface 20 of the coupler shank (as shown in FIG. 1*b*) to stop the lower lockpin rod to rotate, thus the coupler can not be unlocked. However, when the car is in running, it is possible that the lower lockpin rod doesn't move upwardly to the anti-creep position but rotates towards the coupler unlocking direction, at this moment, the anti-creep bulge 10 of the lower lockpin rod is moved away from the anti-creep surface 20 of the coupler shank, i.e. the coupler may be unlocked. In view of the above problem, the lower lockpin rod is provided with an anti-creep bolt configured to limit the lower lockpin rod moving upwardly due to vibration, thereby achieving a dual anti-unlocking performance for coupler.

However, for the operating condition with larger load, the anti-creep bolt is easily bended and deformed. For example, during dumping load without unlocking the coupler, the anti-creep bolt is bended and deformed, and thus the coupler knuckle lock is moved out from a coupler knuckle locking surface under gravity. When a traction vehicle draws the car, the coupler knuckle will spontaneously opened, and couplers are separated, which delays the time of dumping load for the whole train and decreases the efficiency in dumping load. In view of the problem, there is an urge demand for an anti-creep mechanism for coupler which has a reliable dual anti-unlocking performance for coupler and avoids accidentally unlocking coupler.

SUMMARY OF THE INVENTION

In view of the above disadvantages, the technical problem to be solved by the present invention is to provide an anti-creep mechanism for coupler which is reliable in operation to avoid accidentally unlocking the coupler. Based on this, the present invention further provides a coupler having the anti-creep mechanism.

The anti-creep mechanism for coupler according to the present invention includes a lower lockpin rod, a coupler shank and a rotation shaft. The rotation shaft is disposed in an elongate mounting hole of the lower lockpin rod and a circular mounting hole of the coupler shank so that the lower lockpin rod and the coupler shank are hinged together. After the lower lockpin rod is moved upwardly, an anti-creep bulge of the lower lockpin rod abuts against an anti-creep surface of the coupler shank to prevent the lower lockpin rod from swinging and thus driving the lower lockpin mechanism to rotate due to the vibration of car, thereby avoiding abnormally unlocking the coupler. A boss is axially disposed on an upper surface of the rotation shaft; and a groove is axially provided in a wall of the mounting hole of the coupler shank above the rotation shaft to receive the boss of the rotation shaft. The rotation shaft is axially movable relative to the lower lockpin rod and the coupler shank, and has two operating positions so as to allow the lower lockpin rod rotate relative to the rotation shaft and stop the lower lockpin rod rotate, respectively. When the rotation shaft is moved to the first operating position, an inner end portion of the boss is positioned in the elongate mounting hole of the lower lockpin rod, and a top wall of this elongate mounting hole abuts against the boss. If this lower lockpin rod is rotated in a coupler unlocking direction, the anti-creep bulge of the lower lockpin rod may abut against the anti-creep surface of the coupler shank, and the boss may abut against a sidewall of the groove in the coupler shank. When the rotation shaft is moved to the second operating position, the boss is positioned in the groove of the mounting hole of the coupler shank, and the top wall of this elongate mounting hole abuts against an outer circumferential surface of the rotation shaft. At this moment, the lower lockpin rod may be rotated in the coupler unlocking direction.

Preferably, a chamfer is disposed at the inner end portion of the boss.

Preferably, the boss is disposed on an outer circumferential surface of one end portion of the rotation shaft, and a stop shoulder is provided at the one end portion of the rotation shaft; the stop shoulder is configured to abut against the coupler shank to allow the rotation shaft to be in the first operating position.

Preferably, a pull-tab is provided in an axial outer end surface of the stop shoulder to allow the rotation shaft to be in the second operating position.

Preferably, the anti-creep mechanism for coupler further includes a spring, a stop component and a split pin. The spring is provided on the rotation shaft at an outer side of the coupler shank. The stop component is disposed on the rotation shaft at an outer side of the spring. When the rotation shaft is in the second operating position, the spring is compressed and deformed. The split pin is inserted in a radial through hole of the rotation shaft to limit an axial displacement of the stop component.

Preferably, the stop component is provided with a split pin receiving hole, the split pin is inserted in the split pin receiving hole of the stop component and the radial through hole of the rotation shaft.

Preferably, the stop component is an annular stop collar provided on the rotation shaft.

Preferably, an annular groove is provided on an outer cylindrical surface of the annular stop collar, and the split pin receiving hole is disposed at a bottom of the annular groove.

When the coupler is in the locked operating state, the rotation shaft according to the present invention is in the first operating position in which the inner end portion of the boss is positioned in the elongate mounting hole of the lower lockpin rod and the top wall of this elongate mounting hole abuts against the boss. At this moment, if this lower lockpin rod is rotated in the coupler unlocking direction, the anti-creep bulge of the lower lockpin rod abuts against the anti-creep surface of the coupler shank. That is, because of the boss according to the present invention, when the coupler is in the locked state, the anti-creep bulge of the lower lockpin rod will abut against the anti-creep surface of the coupler shank, and is in the anti-creep position. Besides, because the boss of the rotation shaft is relatively fixed in the groove of the mounting hole below the head of the coupler shank, while the cooperating relationship between the boss and the elongate mounting hole of the lower lockpin rod may also limit the lower lockpin rod to rotate in the unlocking direction, and also limit the rotation shaft to rotate relative to the groove of the mounting hole of the coupler shank, thereby performing the function of dual anti-unlocking coupler.

In the coupler unlocking operation, the operator axially moves the rotation shaft to the second operating position. When the boss on the rotation shaft is entirely positioned in the groove of the coupler shank, the top wall of this elongate mounting hole of the lower lockpin rod abuts against an outer circumferential surface of the rotation shaft. That is, the lower lockpin rod moves downwardly, and the anti-creep bulge of the lower lockpin rod moves away from the anti-creep surface of the coupler shank. At this moment, the lower lockpin rod may be rotated to allow the coupler be in the unlock or full open operating state. Compared with the anti-creep bolt of conventional anti-creep mechanism for coupler, the boss disposed on the rotation shaft according to the present invention has a stronger structural strength, and thus efficiently avoid the coupler from being abnormally unlocked caused by the deformation of conventional anti-creep bolt and the vibration of the lockpin mechanism, so as to both ensure operating performance of the coupler in three operation states and achieve a reliable dual anti-unlocking performance for coupler.

In a preferred embodiment of the present invention, the boss has a chamfer at the inner end thereof. This chamfer abuts against the lower lockpin rod and performs a guiding function. Thus, when the rotation shaft is moved from the second operating position to the first operating position, the resistance during moving may be significantly reduced.

In another preferred embodiment of the present invention, the spring, the stop component and the split pin are additionally provided. When the rotation shaft is in the second operating position, the spring disposed between the coupler shank and the stop component is compressed and deformed and thus store the elastic deformation energy. When the coupler is switched from the unlock state to the locked state, the spring force is applied to the stop component and pushes the rotation shaft to the first operating position. That is, when coupler is locked, the anti-creep mechanism allows the rotation shaft and the lower lockpin rod of the coupler return to the anti-creep position spontaneously, which efficiently avoids the coupler from being abnormally unlocked. It is unnecessary for the operator to perform any operation in this process, and thus further improves the operability of the present invention.

The anti-creep mechanism for coupler according to the present invention is applicable to the automatic coupler, and especially to 16 type coupler.

The coupler according to the present invention includes the above-described anti-creep mechanism for coupler.

BRIEF DESCRIPTION OF THE DRAWINGS

FIG. 1 is a schematic structural view of the conventional anti-creep mechanism for coupler; in which

Figure 1A:
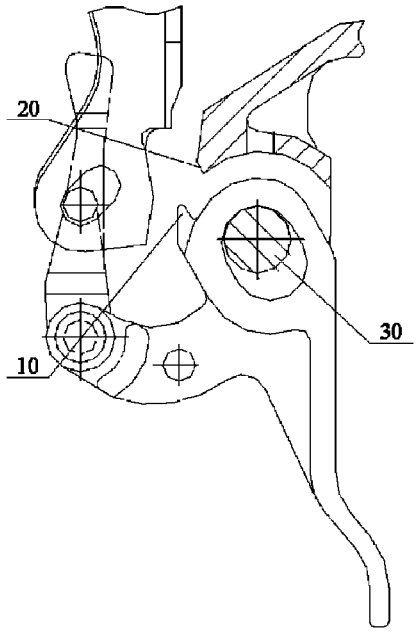
FIG. 1*a* shows the conventional anti-creep mechanism for coupler in a normal position.
Figure 1B:
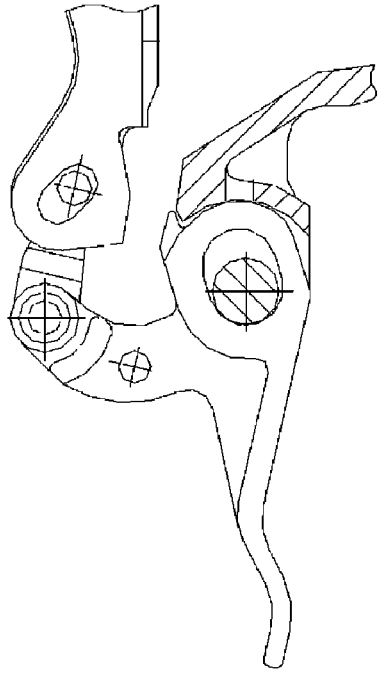
FIG. 1*b* shows the conventional anti-creep mechanism for coupler in an anti-creep position.

Reference numerals in FIGS. 2-10:

| | | | |
|---|---|---|---|
| 1 | lower lockpin rod, | 11 | elongate mounting hole, |
| 12 | anti-creep bulge, | 2 | rotation shaft, |
| 21 | boss, | 22 | stop shoulder, |
| 3 | lower lockpin, | 4 | coupler knuckle lock, |
| 5 | coupler shank, | 51 | circular mounting hole, |
| 52 | anti-creep surface, | 53 | groove, |
| 6 | stop component, | 61 | annular groove, |
| 7 | split pin, | 8 | spring, |
| 9 | pull-tab. | | |

DETAILED DESCRIPTION OF THE INVENTION

The spirit of the present invention lies in that a boss is axially disposed on an upper surface of the rotation shaft; and an axial groove is provided in a wall of the mounting hole of the coupler shank above the rotation shaft to receive the boss of the rotation shaft. The rotation shaft is axially movable relative to the lower lockpin rod and the coupler shank and has two operating positions. When the rotation shaft is in the first operating position, the anti-creep bulge of the lower lockpin rod will abut against the anti-creep surface of the coupler shank in the coupler locked state, and is in a reliable anti-creep state. When the rotation shaft is in the second operating position and the boss on the rotation shaft is entirely positioned in the groove of the coupler shank, the lower lockpin rod moves downwardly, and the anti-creep bulge of the lower lockpin rod moves away from the anti-creep surface of the coupler shank. At this moment, the lower lockpin rod may be rotated to allow the coupler to be in an unlock operating state or in a full open operating state. The boss disposed on the rotation shaft according to the present invention has a stronger structural strength, and thus efficiently avoid the coupler from being abnormally unlocked even in the operating condition with larger load, so as to both ensure the operating performance the coupler in three states and achieve a reliable lock performance of the coupler.

Hereinafter, the present embodiment will be described in detail with reference to drawings in the specification.

Figure 2:
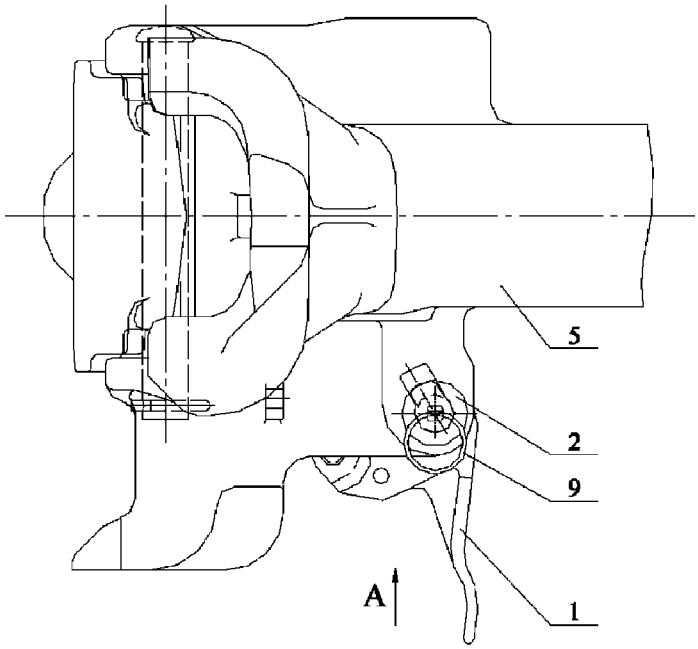
FIG. 2 is a front view of the coupler of the present invention.
Figure 3:
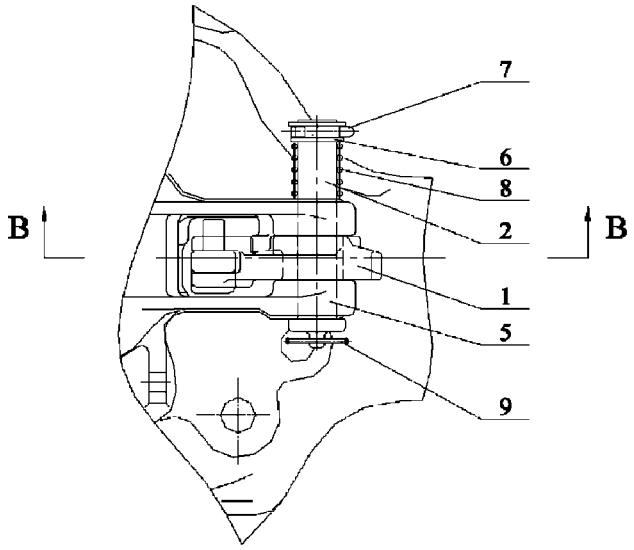
FIG. 3 is a partial view of the coupler along A direction in FIG. 2.
Figure 4:
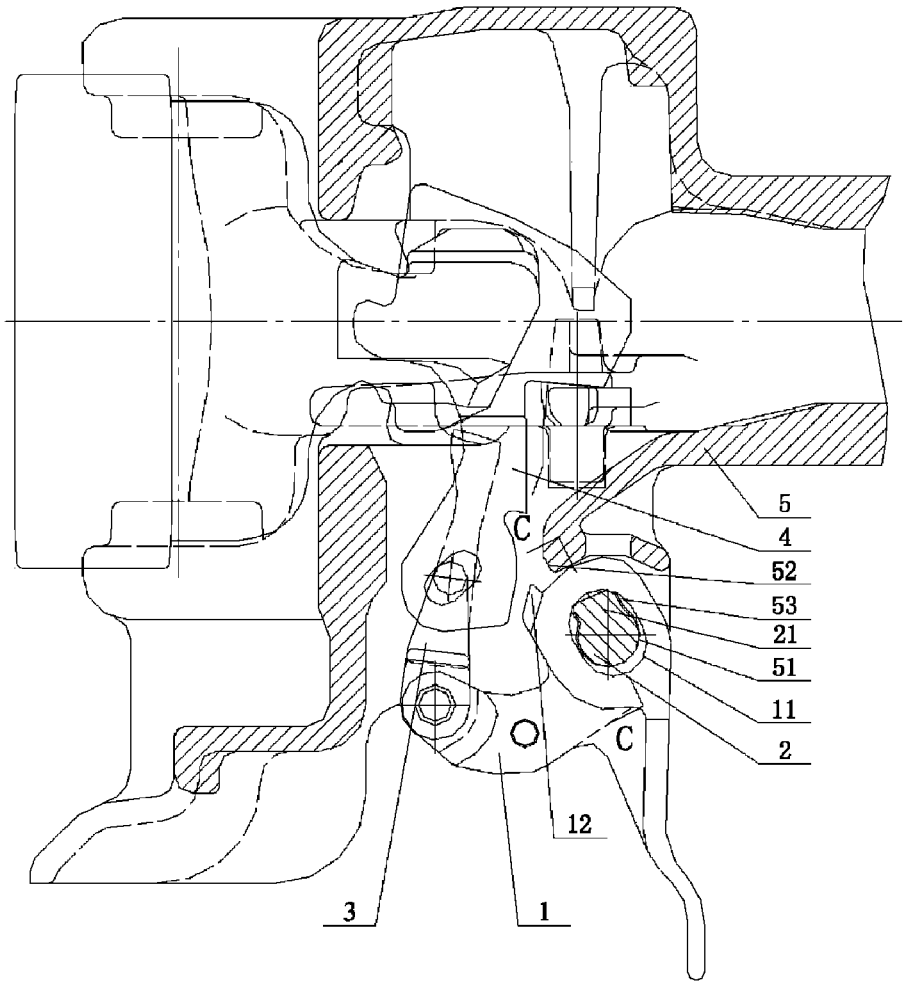
FIG. 4 is a sectional view of the coupler along line B-B shown in FIG. 3.

Referring to FIGS. 2, 3 and 4, the front view of the coupler according to the present invention is shown in FIG. 2.

As shown in FIGS. 2, 3 and 4, a lower lockpin rod 1 and a coupler shank 5 are hinged through a rotation shaft 2. The lower lockpin rod 1 pushes a lower lockpin 3 to move upwardly, and further pushes a coupler knuckle lock 4 into an upper locking cavity of the coupler shank. At this moment, the coupler is in the unlock position. It is noted that, main components such as coupler knuckle, knuckle thrower and so on of the coupler of the present invention are the same as that of the conventional coupler, and thus the detailed description of these main components is omitted therein. The inventive point will be described in detail hereinafter.

As shown in FIG. 4, the anti-creep mechanism for coupler according to the present invention includes the lower lockpin rod 1, the coupler shank 5 and the rotation shaft 2. The rotation shaft 2 is disposed in an elongate mounting hole 11 of the lower lockpin rod 1, a circular mounting hole 51 and a groove 53 of the coupler shank 5, so as to achieve the hinge connection between the lower lockpin rod 1 and the coupler shank 5.

After the lower lockpin rod 1 moves upwardly, an anti-creep bulge 12 of the lower lockpin rod 1 may abut against an anti-creep surface 52 of the coupler shank 5, to avoid the coupler from being abnormally unlocked. That is, if the lower lockpin rod 1 is rotated in the unlocking direction at this moment, the anti-creep bulge 12 will be stopped by the anti-creep surface 52 of the coupler shank 5. The above-described operating principle of the anti-creep structure is the same as that in the prior art.

Figure 5:
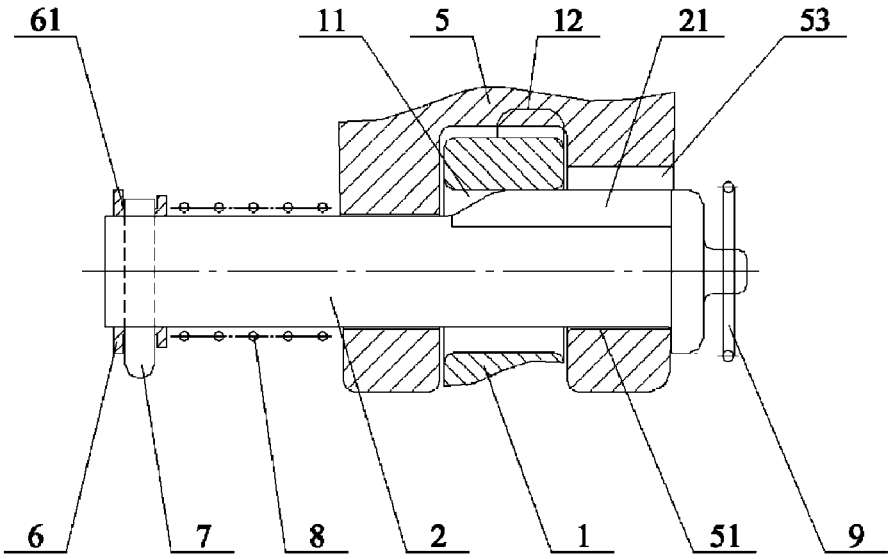
FIG. 5 is a sectional view along line C-C in FIG. 4.

Please also refer to FIG. 5, which is a sectional view along line C-C in FIG. 4.

A boss 21 is axially provided on the upper surface of the rotation shaft 2. A groove 53 is axially provided in the wall of the mounting hole 51 of the coupler shank above the rotation shaft to receive the boss 21 of the rotation shaft. The rotation shaft 2 is axially movable relative to the lower lockpin rod 1 and the coupler shank 5, and has two operating positions. When the rotation shaft 2 is moved to a first operating position as shown in FIG. 5, the inner end portion of the boss 21 is positioned in the elongate mounting hole 11 of the lower lockpin rod 1 and the top wall of the elongate mounting hole 11 abuts against the boss 21. At this moment, if the lower lockpin rod 1 is rotated in the unlocking direction, the anti-creep bulge 12 of the lower lockpin rod 1 abuts against the anti-creep surface 52 of the coupler shank 5. That is, when the rotation shaft 2 is in the first operating position, under the effect of the boss 21, the lower lockpin rod 1 is moved upwardly to the anti-creep position and the rotation of the lower lockpin rod 1 is restrained. At this moment, the coupler is in the locked state. Therefore, with this configuration, the reliability of the coupler in locked operating position is further improved.

Figure 6:
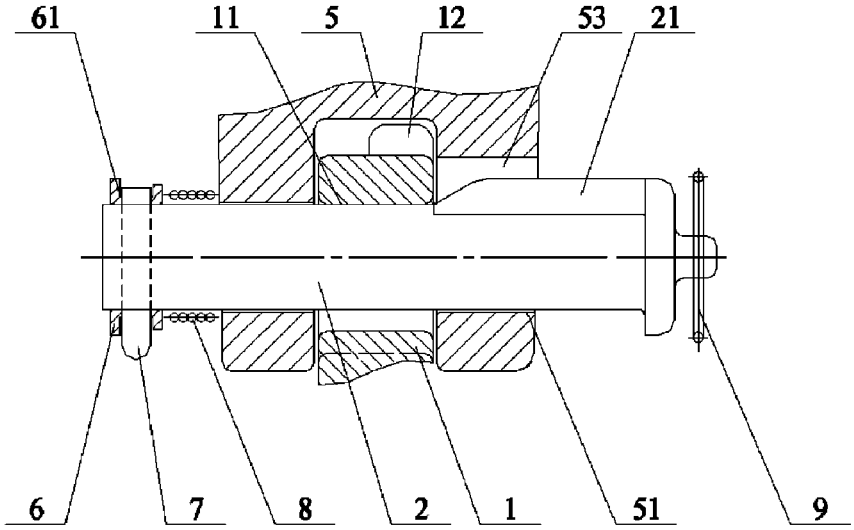
FIG. 6 is a schematic view of the rotation shaft according to the present invention in the second operating position.

As shown in FIG. 6, when the rotation shaft 2 is moved to the second operating position, the boss 21 is positioned in the groove 53 of the mounting hole 51 of the coupler shank, and the top wall of the elongate mounting hole 11 of the lower lockpin rod abuts against the outer circumferential surface of the rotation shaft 2; That is, the lower lockpin rod 1 is moved downwardly, and the anti-creep bulge 12 thereof moves away from the anti-creep surface 52 of the coupler shank 5. When the rotation shaft 2 is in the second operating position, if the lower lockpin rod 1 is rotated, the coupler will be in the unlock or full open operating state.

Figure 7:
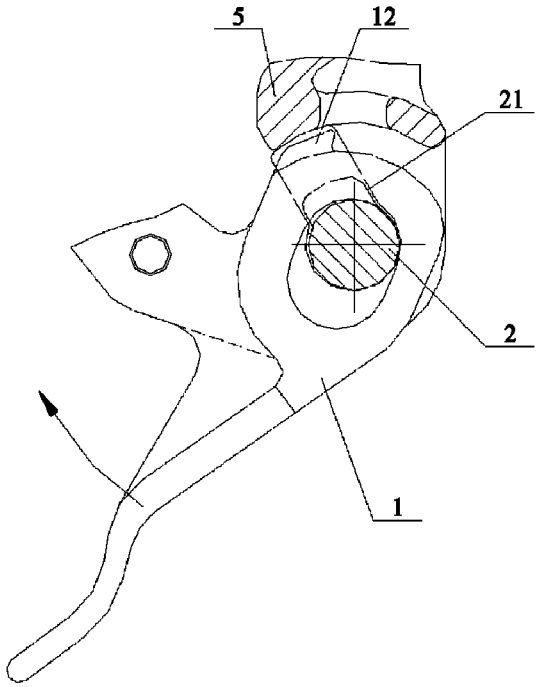
FIG. 7 is a schematic view of the lower lockpin rod according to the present invention in the unlock state.

As shown in FIG. 7, when unlocking the coupler, the lower lockpin rod 1 is rotated around the rotation shaft 2 and the elongate mounting hole 11 of the lower lockpin rod 2 and the boss 21 are staggered, while the boss 21 is stopped by the sidewall of the mounting hole of the lower lockpin rod so as to be kept in the current position automatically and can not return to the first operating position, so the boss 21 can not enter into the elongate mounting hole 11 of the lower lockpin rod 1, which can not affect the unlocking performance of coupler and ensures the reliability in the coupler unlocking operation.

Figure 8:
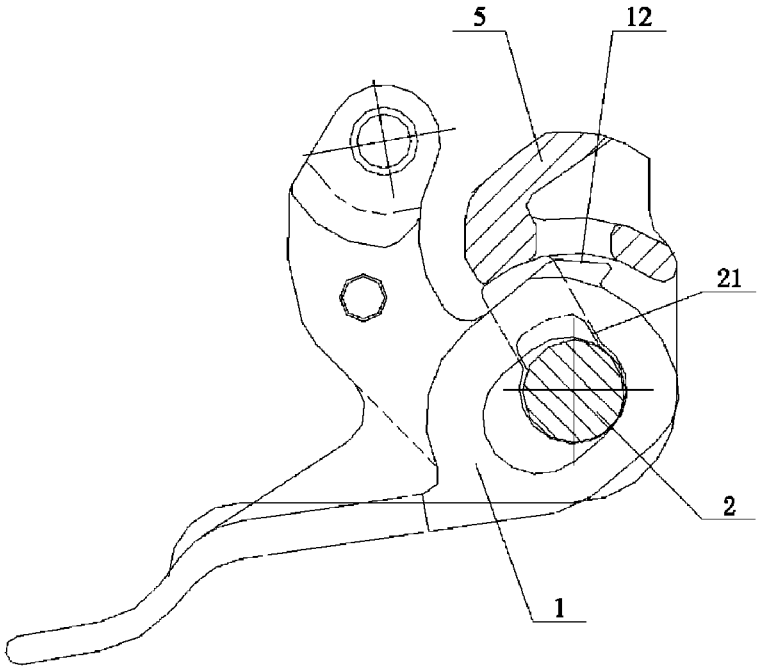
FIG. 8 is a schematic view of the lower lockpin rod according to the present invention in the full open state.

As shown in FIG. 8, when the lower lockpin rod 1 is rotated from the unlock position to the limit position, i.e. the full open position, the coupler knuckle may be rotated around the coupler knuckle pin to be opened.

Compared with the anti-creep bolt of the conventional anti-creep mechanism for coupler, the boss 21 disposed on the rotation shaft 2 according to the present invention has a relatively high structural strength, which can efficiently avoid the coupler from being abnormally unlocked even in an operating condition with larger load, so as to ensure the reliable and stable operating performance of the coupler in three states, and achieve a reliable lock performance of the coupler.

Figure 9:
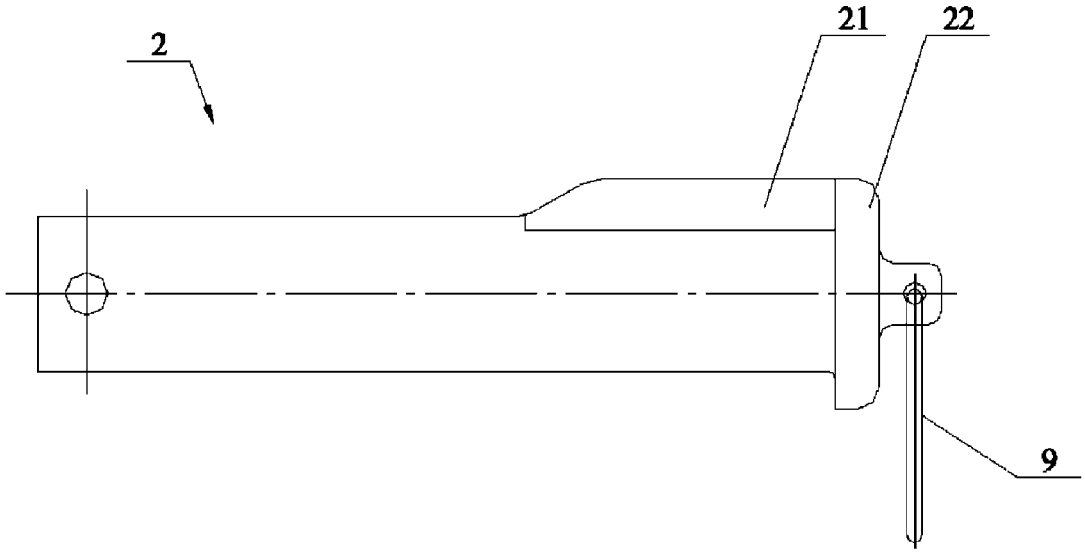
FIG. 9 is a front view of the rotation shaft in the particular embodiment.
Figure 10:
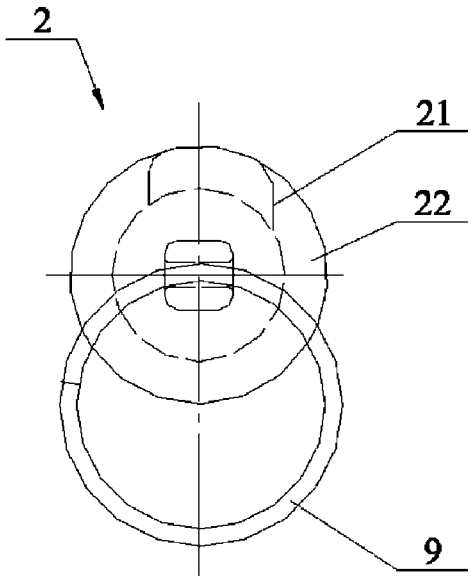
FIG. 10 is a right view of the rotation shaft in the particular embodiment.

In prior art, it is necessary for an operator to manually manipulate the anti-creep bolt of conventional the anti-creep mechanism for coupler before unlocking the coupler or after locking the coupler. The mechanism according to the present invention can spontaneously be in the locked position when the coupler is closed, that is, the rotation shaft 2 is spontaneously switched from the second operating position to the first operating position, so as to improve the operability of the coupler according to the present invention. Please also refer to FIGS. 9 and 10, in which, FIG. 9 is a front view of the rotation shaft, and FIG. 10 is a right view of the rotation shaft.

The boss 21 is disposed on the outer circumferential surface of one end portion of the rotation shaft 2, and a stop shoulder 22 is provided at the end of the rotation shaft 2 adjacent to the outer side of the boss 21. As shown in FIG. 5, the stop shoulder 22 is configured to abut against the coupler shank 5 such that the rotation shaft 2 is in the first operating position.

As shown in the figures, the boss 21 has an elongate structure extending in the axial direction, so as to facilitate the slide in the groove 53, so that the rotation shaft 2 may be switched between the two operating positions. It is appreciated that the boss 21 may have any appropriate structure which can perform the function described above, for example, a block structure.

A spring 8 is installed surround the rotation shaft 2 outside the coupler shank 5. A stop component 6 is provided on rotation shaft 2 at the outer side of the spring 8. When assembling, if desired, the spring 8 may be pre-compressed. When the rotation shaft 2 is in the second operating position, the spring 8 is further compressed and deformed. A split pin 7 is inserted in a radial through hole of the rotation shaft 2 to limit the axial displacement of the stop component 6.

In operating, when the rotation shaft 2 is in the second operating position, the spring 8 disposed between the coupler shank 5 and the stop component 6 is compressed and deformed and thus store the elastic deformation energy. When the coupler is in the locked state, the lower lockpin rod 1 is rotated from the unlock position back to the locked position, and the stop component 6 makes the rotation shaft 2 to move to the first operating position under a spring force, then, the lower lockpin rod 1 is moved upwardly to the anti-creep position which is an initial locked position after assembling, as a result, the coupler can not be unlocked spontaneously. It is unnecessary for an operator to perform any operation in this process, and it is ensured that this mechanism can spontaneously be in the locked position when the coupler is closed, which may further improves the operability of the present invention.

Besides, the boss 21 has a chamfer at the inner end thereof. In this way, when the rotation shaft 2 is moved from the second operating position to the first operating position, the boss body abuts against the lower lockpin rod 1 at this chamfer to perform a guiding function; thereby the resistance during moving may be significantly reduced.

As shown in the figures, a pull-tab 9 is provided in the axial outer end surface of the stop shoulder 22 to facilitate moving the rotation shaft 2 to the second operating position. When the rotation shaft 2 is required to move from the first operating position to the second operating position, the operator simply pulls the pull-tab 9 at the outer end of the rotation shaft 2 to achieve the above switch operation.

It is appreciated that the assembling relationship between the pull-tab 9 and the rotation shaft 2 may be implemented by many means, for example, the pull-tab 9 is provided with an opening and is welded at this opening after it is assembled with the rotation shaft.

Specifically, the stop component 6 is provided with a split pin receiving hole. The split pin 7 is inserted in the split pin receiving hole of the stop component 6 and the radial through hole of the rotation shaft 2.

Preferably, the stop component 6 may be an annular stop collar provided on the rotation shaft 2. An annular groove 61 is provided on the outer cylindrical surface of the annular stop collar. As shown in FIGS. 5 and 6, the split pin receiving hole is disposed at the bottom of the annular groove 61. Compared with the conventional standard plain washer, the axial fitting dimension between the annular stop collar according to the present embodiment and the rotation shaft is longer, and since the annular stop collar is a customized element, a radial fitting clearance between the inner diameter of the annular stop collar and the outer diameter of the rotation shaft 2 may be minimized. Therefore, as the rotation shaft is switched between the two operating positions, the contact surface between the annular stop collar and the spring 8 is substantially perpendicular to the centre line of the rotation shaft, such that the spring 8 may be applied a uniform force, which further ensures the reliability in operation.

The anti-creep mechanism for coupler of the present invention is an improvement based on the conventional anti-creep mechanism for coupler. Specifically, the anti-creep bolt outside the coupler is omitted. Besides, by modifying the structure of the rotation shaft and adding the return spring and the stop component, the switch of the coupler between the locked position and the unlock position may be made without using any auxiliary means. The coupler may be unlocked by pulling out the rotation shaft with the pull-tab and rotating the lower lockpin rod.

When the coupler returns to the locked position, the anti-creep mechanism may spontaneously return to the anti-creep position, which may omits the operation for installing the anti-creep bolt after the conventional coupler is locked. Therefore, the anti-creep performance of the coupler is increased, and the reliability in coupling between couplers is increased; besides, the coupler may be self-locked, and the operating efficiency and the reliability and safety are improved.

The preferred embodiment of the present invention has been described. However, it should be noted that for persons skilled in the art, many improvements and modifications may also be made to the present invention without departing from the principle of the present invention. The improvements and modifications also fall into the protection scope of the present invention.

What is claimed is:

1. An anti-creep mechanism for a coupler comprising a lower lockpin rod, a coupler shank and a rotation shaft, wherein the rotation shaft is disposed in an elongate mounting hole of the lower lockpin rod and a circular mounting hole of the coupler shank so that the lower lockpin rod and the coupler shank are hinged together, wherein after the lower lockpin rod is moved upwardly, an anti-creep bulge of the lower lockpin rod abuts against an anti-creep surface of the coupler shank to prevent the coupler from being abnormally unlocked, further comprising:

a boss axially disposed on an upper surface of the rotation shaft; and a groove axially provided in a wall of the mounting hole of the coupler shank above the rotation shaft to receive the boss of the rotation shaft, wherein the rotation shaft is axially movable relative to the lower lockpin rod and the coupler shank and has two operating positions, wherein when the rotation shaft is moved to a first operating position, an inner end portion of the boss is positioned in the elongate mounting hole of the lower lockpin rod, and a top wall of the elongate mounting hole abuts against the boss, and if the lower lockpin rod is rotated in a coupler unlocking direction, the anti-creep bulge of the lower lockpin rod abuts against the anti-creep surface of the coupler shank and the boss abuts against a sidewall of the groove in the coupler shank; and wherein when the rotation shaft is moved to a second operating position, the boss is positioned in the groove of the mounting hole of the coupler shank, and the top wall of the elongate mounting hole abuts against an outer circumferential surface of the rotation shaft.

2. The anti-creep mechanism for coupler according to claim 1, wherein, a chamfer is disposed at the inner end portion of the boss.

3. The anti-creep mechanism for coupler according to claim 1, wherein the boss is disposed on an outer circumferential surface of one end portion of the rotation shaft, and a stop shoulder is provided at the one end portion of the rotation shaft, wherein the stop shoulder is configured to abut against the coupler shank to allow the rotation shaft to be in the first operating position.

4. The anti-creep mechanism for coupler according to claim 3, wherein, a pull-tab is provided in an axial outer end surface of the stop shoulder to allow the rotation shaft to be in the second operating position.

5. The anti-creep mechanism for coupler according to claim 4, further comprising:

a spring provided on the rotation shaft at an outer side of the coupler shank;

a stop component disposed on the rotation shaft at an outer side of the spring, wherein when the rotation shaft is in the second operating position, the spring is compressed and deformed; and a split pin inserted in a radial through hole of the rotation shaft to limit an axial displacement of the stop component.

6. The anti-creep mechanism for coupler according to claim 5, wherein the stop component is provided with a split pin receiving hole, and the split pin is inserted in the split pin receiving hole of the stop component and the radial through hole of the rotation shaft.

7. The anti-creep mechanism for coupler according to claim 6, wherein the stop component is an annular stop collar provided on the rotation shaft.

8. The anti-creep mechanism for coupler according to claim 7, wherein an annular groove is provided on an outer cylindrical surface of the annular stop collar, and the split pin receiving hole is disposed at a bottom of the annular groove.

9. A coupler comprising an anti-creep mechanism for coupler according to claim 1.

* * * * *

UNITED STATES PATENT AND TRADEMARK OFFICE

CERTIFICATE OF CORRECTION

PATENT NO. : 8,186,525 B2
APPLICATION NO. : 12/810873
DATED : May 29, 2012
INVENTOR(S) : Yingjun Cui et al.

It is certified that error appears in the above-identified patent and that said Letters Patent is hereby corrected as shown below:

Title Page,
Item (86) PCT No.:
Delete "PCT/CN2009/072680" and insert
-- PCT/CN2009/072860 --.

Signed and Sealed this
Thirteenth Day of November, 2012

David J. Kappos

David J. Kappos
*Director of the United States Patent and Trademark Office*